US012194348B2

(12) United States Patent
Kereszy

(10) Patent No.: US 12,194,348 B2
(45) Date of Patent: Jan. 14, 2025

(54) SWIMMING STARTING BLOCK FRONT FOOT SUPPORT

(71) Applicant: Tamas Kereszy, Pompano Beach, FL (US)

(72) Inventor: Tamas Kereszy, Pompano Beach, FL (US)

( * ) Notice: Subject to any disclaimer, the term of this patent is extended or adjusted under 35 U.S.C. 154(b) by 256 days.

(21) Appl. No.: 17/708,537

(22) Filed: Mar. 30, 2022

(65) Prior Publication Data

US 2022/0401778 A1 Dec. 22, 2022

Related U.S. Application Data

(60) Provisional application No. 63/202,718, filed on Jun. 22, 2021.

(51) Int. Cl.
*A63B 5/10* (2006.01)
*A63B 69/12* (2006.01)

(52) U.S. Cl.
CPC ..... *A63B 5/10* (2013.01); *A63B 69/12* (2013.01)

(58) Field of Classification Search
None
See application file for complete search history.

(56) References Cited

U.S. PATENT DOCUMENTS 3,271,787 A * 9/1966 Clary ..... E04H 4/06 52/716.2
3,300,250 A * 1/1967 Dollgener ..... A47C 31/02 473/32
3,524,291 A * 8/1970 Rozanki ..... E04D 13/1415 52/287.1
3,628,198 A * 12/1971 Katzman ..... E04H 4/142 4/488
3,641,595 A * 2/1972 Viessmann ..... E04H 4/0018 52/630
3,725,188 A * 4/1973 Kalt ..... A47B 95/043 206/326

(Continued)

FOREIGN PATENT DOCUMENTS

AU 2019150208 A1 5/2020
CA 3015224 A1 * 2/2019 ..... A47C 20/021

(Continued)

OTHER PUBLICATIONS

PCT International Search Report for corresponding PCT Patent Application No. PCT/IB2022/053919 issued Jul. 16, 2022.

(Continued)

*Primary Examiner* — Shila Jalalzadeh Abyaneh
(74) *Attorney, Agent, or Firm* — DANIEL S. POLLEY, P.A.

(57) ABSTRACT

A swimming starting block front foot support that can be provided in several configurations and can be strapped or otherwise removably secured to a conventional swim starting block or built into new starting blocks. The front foot support block allows the front foot to be in a substantially horizontal position, which reduces reaction time and increases stability during start, and allows the toes of the front foot to wrap around or otherwise contact a front curved portion of the front foot support, which allows the user to have more force when jumping/diving off the swim block and into an adjacent swimming pool.

19 Claims, 6 Drawing Sheets

(56) References Cited

U.S. PATENT DOCUMENTS 3,746,335 A * 7/1973 Fichter ..... A63K 3/023 482/19
3,777,318 A * 12/1973 Stillman, Jr. ..... E04H 4/142 4/506
3,811,236 A * 5/1974 Fiddes ..... B29C 70/86 52/102
3,835,481 A * 9/1974 Engelhart ..... E04H 4/142 52/169.7
3,916,214 A * 10/1975 Coble, Jr. ..... A63B 71/0605 307/119
D244,166 S * 5/1977 Wittenberg ..... D25/119
4,134,583 A * 1/1979 Davidson ..... A63B 69/12 482/19
4,229,844 A * 10/1980 Cribben ..... E04H 4/142 52/716.2
4,441,758 A * 4/1984 Fleischer ..... A47C 16/025 297/423.46
D280,052 S * 8/1985 Hypponen ..... D6/349
4,678,234 A * 7/1987 Wilson ..... A47C 16/025 297/423.45
5,208,084 A * 5/1993 Rutz ..... A47B 21/0371 52/287.1
5,284,465 A * 2/1994 Homan, Jr. ..... A63B 23/0405 482/79
5,349,569 A * 9/1994 Tanaka ..... G07C 1/24 368/110
5,423,093 A * 6/1995 Hall-Vandis ..... E04H 4/14 5/663
D371,462 S * 7/1996 Grossmith ..... D6/349
5,678,254 A * 10/1997 Jardim ..... B60R 13/04 5/663
D403,080 S * 12/1998 Mignone, Jr. ..... D25/2
D431,772 S * 10/2000 Tsui ..... D8/403
6,393,632 B1 * 5/2002 Epple ..... E04H 4/148 4/502
D460,199 S * 7/2002 Brito ..... D25/113
D461,010 S * 7/2002 Brito ..... D25/113
6,523,188 B1 2/2003 Kiefer
6,637,844 B1 * 10/2003 Luciano, Jr. ..... A47C 16/02 312/223.1
6,675,402 B1 * 1/2004 Maurer ..... E04H 4/141 52/169.7
D509,277 S * 9/2005 Morral Gispert ..... A63B 5/10 D21/802
7,101,344 B1 * 9/2006 Wu ..... A61H 7/001 601/134
7,114,200 B1 * 10/2006 Bennett ..... E04H 4/141 4/DIG. 18
7,436,327 B2 10/2008 Kaski
D625,595 S * 10/2010 Park ..... D8/402
7,833,107 B1 * 11/2010 Garcia-Morales ..... A63B 69/12 434/254
D655,825 S * 3/2012 Fleites ..... D25/113
8,360,940 B2 * 1/2013 Kole ..... A63B 21/0552 482/79
9,623,272 B2 4/2017 Drozdowski
10,245,524 B2 * 4/2019 Stockinger ..... A63K 3/02
10,285,839 B2 * 5/2019 Breibart ..... A63B 21/4013
10,765,913 B2 * 9/2020 Michaud ..... A63B 1/00
10,780,367 B2 * 9/2020 Henry ..... A63K 3/023
11,324,998 B2 * 5/2022 Amis ..... A61H 1/0266
2005/0227813 A1 * 10/2005 Curry ..... A63B 5/10 482/30
2011/0152047 A1 * 6/2011 Bedard ..... A63B 23/085 482/142
2012/0040810 A1 * 2/2012 Astilla ..... A63B 21/0023 482/131
2012/0192346 A1 8/2012 Maas
2013/0095980 A1 * 4/2013 Solanyk ..... A63K 3/023 482/55
2013/0252788 A1 9/2013 Kaiei
2014/0171271 A1 6/2014 Solanyk
2014/0274589 A1 * 9/2014 Harkins ..... A63B 21/4033 482/91
2015/0184408 A1 * 7/2015 Povzner ..... A63B 71/0054 4/504
2015/0190665 A1 * 7/2015 Drozdowski ..... E04H 4/14 4/496
2020/0324164 A1 * 10/2020 Amis ..... A61H 1/0237

FOREIGN PATENT DOCUMENTS

CN 206376593 U * 8/2017
DE 2301379 A1 * 7/1974
DE 2517738 A1 * 11/1976
DE 19856995 A1 * 6/1999 ..... A63B 21/00047
KR 20140104271 A * 8/2014
WO 2011/012261 A2 2/2011
WO WO-2013036117 A1 * 3/2013 ..... A63B 5/10
WO WO-2019040657 A1 * 2/2019 ..... A61H 1/00
WO WO-2021166003 A1 * 8/2021

OTHER PUBLICATIONS

PCT Written Opinion for corresponding PCT Patent Application No. PCT/IB2022/053919 issued Jul. 16, 2022.

* cited by examiner

SWIMMING STARTING BLOCK FRONT FOOT SUPPORT

This application claims priority to U.S. Application Ser. No. 63/202,718, filed Jun. 22, 2021, which application is incorporated by reference in its entirety for all purposes.

1. FIELD OF THE DISCLOSURE

The disclosure relates generally to swim starting blocks and more specifically to swim platforms for a swim starting block.

2. BACKGROUND

In swimming and particularly during swim competitions, the swimmers are allowed to start (i.e. dive into the pool) from starting blocks, which allows the swimmers to gain momentum before landing in the water. Current starting block used at major international swim competitions include an angled ledge supporting the rear foot of the swimmer during a start. In the starting position, the swimmer is able to put one (i.e. either right or left) foot on the rear angled ledge, while the other foot is positioned at the front edge of the conventional starting block. One non-limiting disadvantage of current starting blocks is that they are only directed to the rear foot, and the swimmer can only use the muscles of his front foot with conventional starting blocks to a minimum degree for kick-off due to the small support possibility. The novel starting block disclosed herein is directed to overcoming one or more of the disadvantages currently experienced by swimmers using conventional starting blocks directed to the rear/back foot of the swimmer.

SUMMARY OF THE DISCLOSURE

Generally, disclosed is a swimming starting block front foot support/starting block that can be provided in several configurations, including, without limitation, a one swimmer's/user's foot wide (i.e. wide enough to accommodate one foot of the swimmer/user) support strapped or otherwise secured onto existing starting blocks/swimming platforms, a full width (i.e. wide enough to accommodate both feet of the swimmer/user) support strapped or otherwise secured onto existing starting blocks/swimming platforms, a full width support also including a back foot support (i.e. front/back foot support combination platform) that can be strapped or otherwise secured (preferably removably secured) to the conventional swim starting block, and a new starting block having the front and back foot support features described herein built into the new starting block.

In the single foot front foot support novel starting block, in one embodiment the novel front foot starting block can be placed and fixed/secured on or to an existing starting block by any conventional securement mechanism. In one non-limiting embodiment the novel front foot starting block can be secured by a strap member.

Use of the front foot support (whether provided as a single foot separate starting block, a multiple swimmer's foot/full width separate starting block, a combination starting block having the front foot support and the rear foot support, or a new platform having the front foot support and rear foot support built/incorporated therein), allows the swimmer (preferably in conjunction with the rear foot support/starting block) to exert more force to move away from the starting block and thus jump farther away after starting. Thus, with use of any of the embodiments described herein, the swimmer can jump farther and faster than currently available with just the back foot support/starting block, which should allow the swimmer to achieve a better time result during a competition or any other "timed" swimming activity. The curved portion also reduces the skin injuries on the swimmers' toes that is currently caused by the small area where a large force is applied, and because pressure is force divided by area.

When the novel front foot support (in any of the shown and/or described embodiments) is provided, the upper surface of the front foot support/front foot support portion allows the front foot of the swimmer (excluding the toe portion) to be positioned horizontal or substantially horizontal. With a conventional starting block (with or without the back foot support), the upper surface slopes downward starting from its back edge to its front edge. The bottom surface of the novel front foot support (excluding where it is built in to a new platform) can be similarly angled to the slope angle, such that when the front foot support is positioned on the upper surface of the swim platform, the upper surface of the front foot support becomes horizontal or substantially horizontal. Thus, the user's front foot (excluding the toe portion) rests in a horizontal or substantially horizontal position, with use of the disclosed novel front foot support.

The front edge of the novel front foot support (preferably in all embodiments) can be rounded and/or curved. The novel front foot support/starting block can be provided with a single continuous upper-surface support between the front and rear edges. In certain embodiments at least a portion of the upper surface can be provided with one or more grooves preferably extending from one side of the starting block to the opposite side of the starting block. The grooves can provide an anti-slip benefit for the starting block and can allow water from the swimmer's foot to drain out and not accumulate on the upper surface of the starting block. As an alternative to the one or more grooves or in addition thereto, at least a portion of the upper surface of the starting block, which can also include the rounded toe area though not limiting, can be provided with a conventional anti-slip material/textured surface.

As noted above, the front top edge of the front foot support/starting block can be rounded or curved so the swimmer's toes on their front foot can contact the rounded curved surface to allow the front foot to also be pushed off from (i.e. exert more force) by the swimmer. Thus, the front foot is also supported and allows the swimmer to move away from the starting platform with more force and distance. The angle created between the swimmer's leg and upper foot can be reduced, causing the calf muscle to tighten like a spring, which in turn reduces their reaction times during the start.

A lip or flange member preferably extends downward from the rounded/curved surface and contacts the surface of the swim platform when securing the novel front starting block to an existing swim platform. The lip/flange member acts as a stop member against the swim platform and helps to prevent movement of the front starting block during use. The lip or flange member can also be constructed or configured such that an inner portion of the novel front foot support/starting block's rounded curved surface can be flush or substantially flush with the front edge of the existing starting blocks.

The novel front foot support/starting block embodiments that are attached to an existing swim platform (i.e. not incorporated into a newly manufactured platform) can be easily placed and secured on the existing starting/swim block/platform and can also be easily removed therefrom. For these embodiments, the novel device can be an independent structure and monolithically formed or constructed integral as a one-piece member (excluding any securement straps or other securement mechanism.

The novel front foot starting block embodiments disclosed herein satisfy the swimmer's long-felt desires and needs for a device that will allow them to jump farther with a reduced reaction time and that will help them reduce their skin toe injuries from repetitively performing the swim competition starting actions/motions over and over during practice sessions.

Certain novel features and/or benefits of the disclosed novel front foot support, include, without limitation:

1. The upper surface portion of the front foot support can create a horizontal or substantially horizontal front foot support surface, which can allow the swimmer to stand with more stability on the block, while the swimmer's calf muscle can be stretched for improved reaction time and farther jump potential.
2. The front curved portion of the front foot support can allow swimmers to jump off at their ideal departure angle for their maximum range into the water.
3. The continuously curving front foot support surface starting with the horizontal/substantially horizontal top portion, continuing with the curved portion, and ending with the front portion below the curved portion can allow swimmers to fully support their front foot and exert a force through their entire foot surface instead of just the toes. This can result in more powerful starts, eliminates/reduces toe injuries, and enables para-athletes and masters-athletes to use the starting block with more stability.
4. The grooves along the surface of the front foot support in certain embodiments allow for the water to efficiently leave the surface of the foot support, enabling the front foot to have a stable grip.

DETAILED DESCRIPTION

Figure 1:
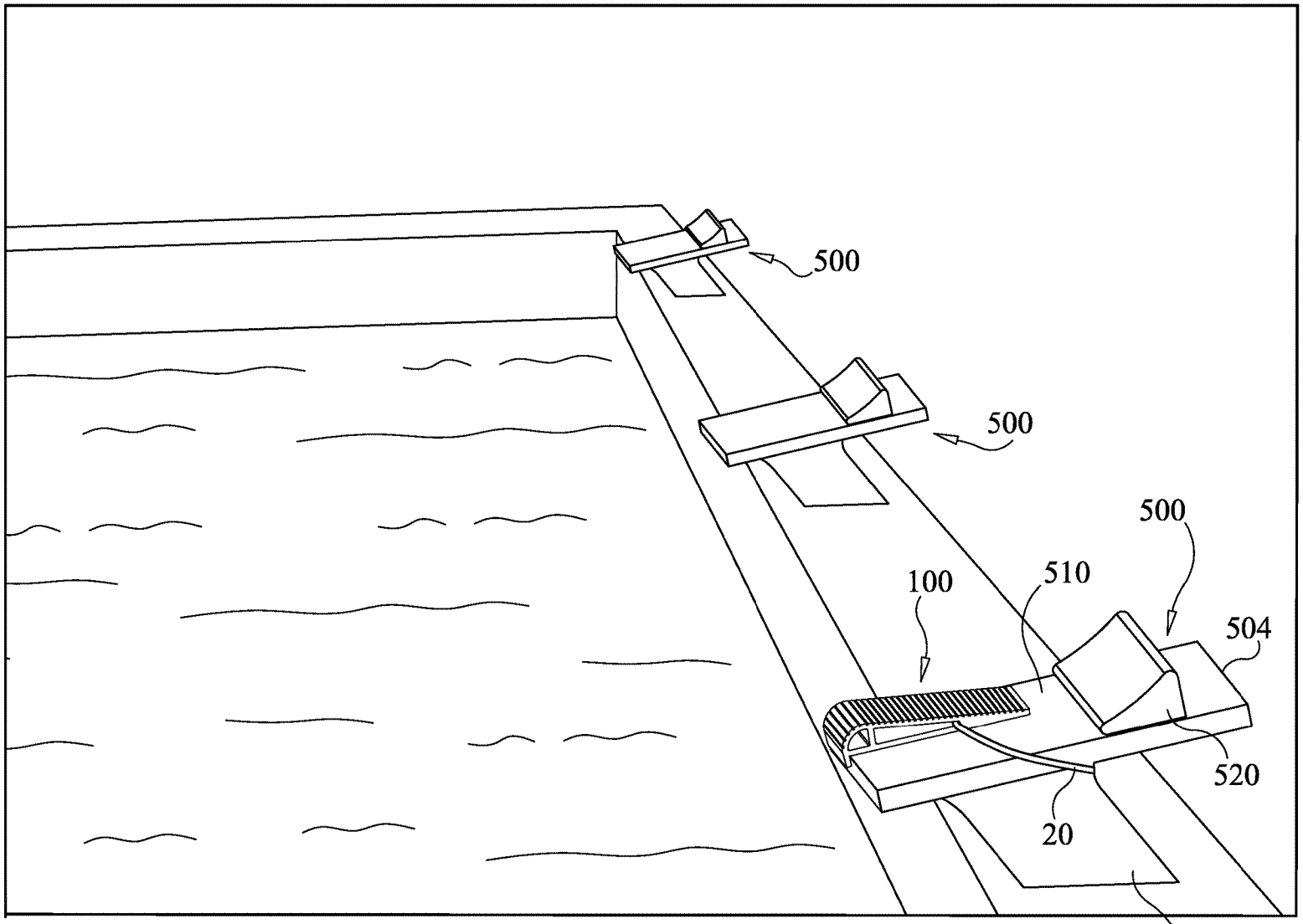
FIG. 1 is a perspective view showing a first embodiment for a novel front foot starting block removably secured to an existing swim/starting block/platform in accordance with the present disclosure.

As seen in FIG. 1 a first non-limiting embodiment for a front foot support/starting block is shown and generally designated as front starting block 100. As seen, front starting block is shown secured to s conventional swim block 500 having a base or foundation 502 and a platform member 504 positioned on top of base 502. Platform member 504 can include an upper surface 510. A conventional rear foot starting block 520 is shown positioned towards the rear of platform member 504 and can having a ramp/sloped surface where the swimmer's rear foot rest against in the starting position. Without the front starting block 100 secured to swim block 500, in use the swimmer's front foot merely rests upon a front area of upper surface 510 and non-rounded straight edge is provided at the front end of platform 504. Front starting block 100 can be preferably secured to swim block 500 by a strap member 20, which can be provided with a conventional tightener/length adjuster to keep strap member 20 in a tight configuration to help prevent movement of front starting block 100 once positioned on upper surface 510. The disclosure is not considered limited to using a strap, and any conventional attachment/securement mechanism, now known or later developed, for keeping front starting block 100 in position on top of upper surface 510.

Figure 2:
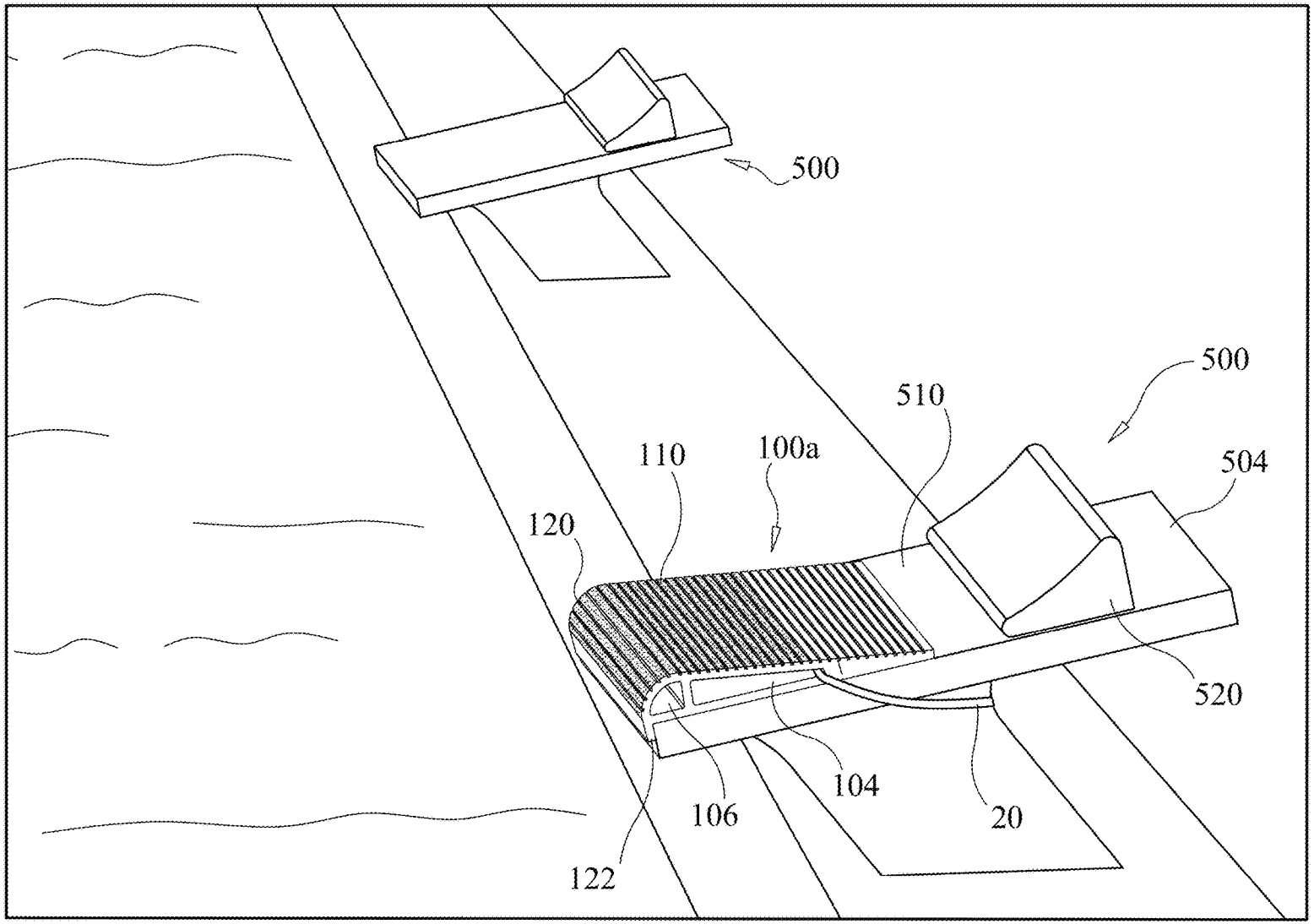
FIG. 2 is a perspective view showing another embodiment for the novel front foot starting block removably secured to an existing swim/starting block/platform in accordance with the present disclosure.

FIG. 2 illustrates a second non-limiting embodiment for the front foot support/starting block and is generally designated as front starting block 100*a*. The primary difference between block 100 and block 100*a* is the width of the block's body. Front starting block 100 can be preferably provided with a width to accommodate a single foot of the swimmer. Therefore, the user positions block 100 at either the left front portion (where the swimmer's left foot will be the front foot) or at the right front portion (where the swimmer's right foot will be the front foot). With block 100*a*, the preferred width is sufficient to accommodate both feet of the swimmer, so once block 100*a* is secured to swim block 500 it can be used for either foot as the front foot. Though not limiting or required, in one embodiment the width of front starting block 100*a* can be the same is substantially the same as the width of swim platform 504. Preferably, though non-limiting, in one embodiment, front foot support/starting block 100 can be anywhere between about 50 cm to about 70 cm in width.

Front starting block 100*a* can be secured to swim block 500 similarly to as described above and below for front starting block 100. The below discussion for FIGS. 4-6 concerning front starting block 100 is also applicable to front starting block 100*a* and is incorporated by reference.

Figure 3:
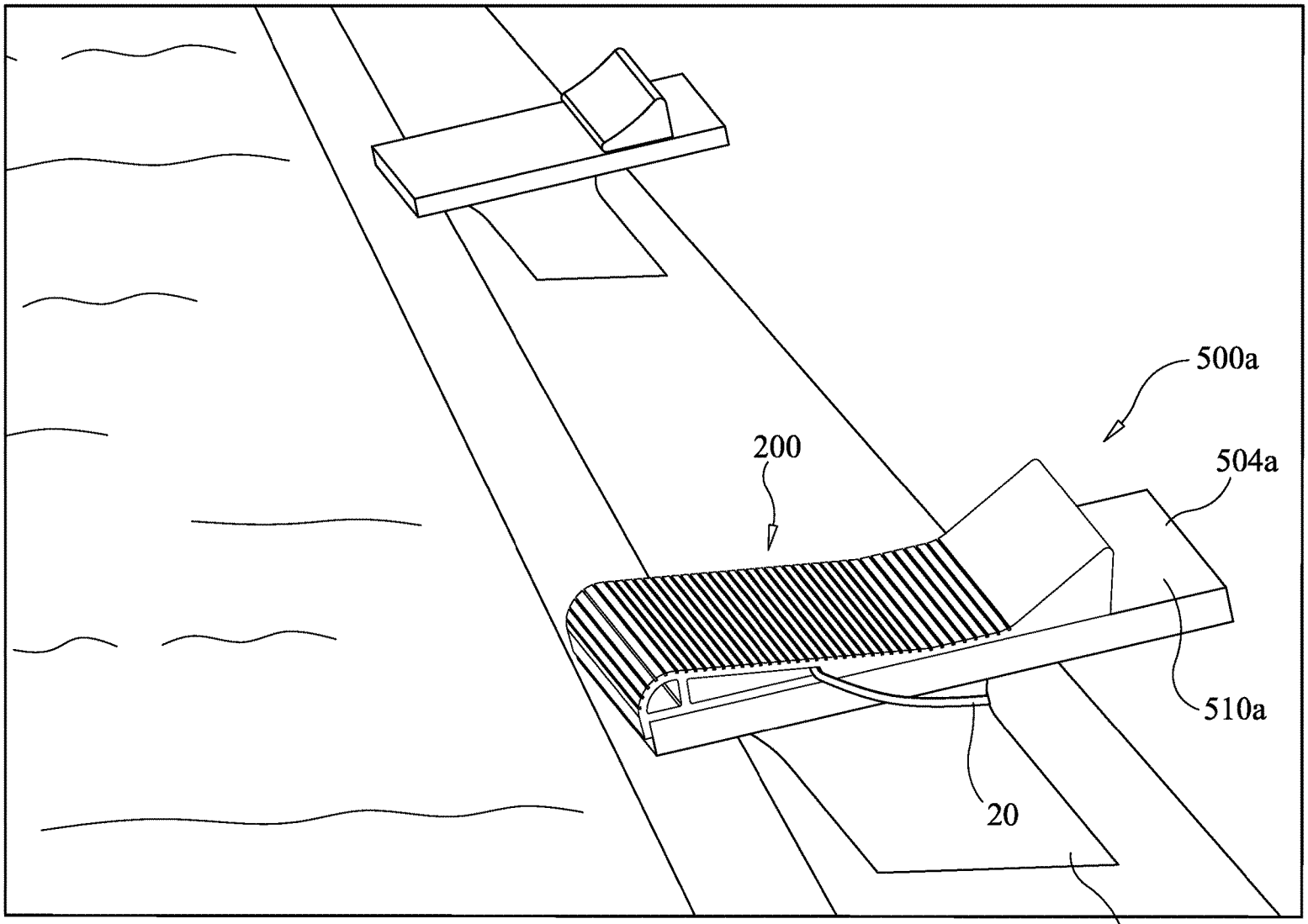
FIG. 3 is a perspective view showing a further embodiment for the novel front foot starting block removably secured to an existing swim/starting block/platform and also incorporated a back foot support ledge/surface in accordance with the present disclosure.

FIG. 3 illustrates a third non-limiting embodiment for a combination front foot support and rear foot support starting block and is generally designated as combo starting block 200. Combo starting block 200 can be secured to swim block 500 similarly to as described above and below for front starting block 100 or starting block 100*a*. The below discussion for FIGS. 4-6 concerning front starting block 100 is also applicable to the front starting block portion of combo starting block 200 and is incorporated by reference.

Figure 4:
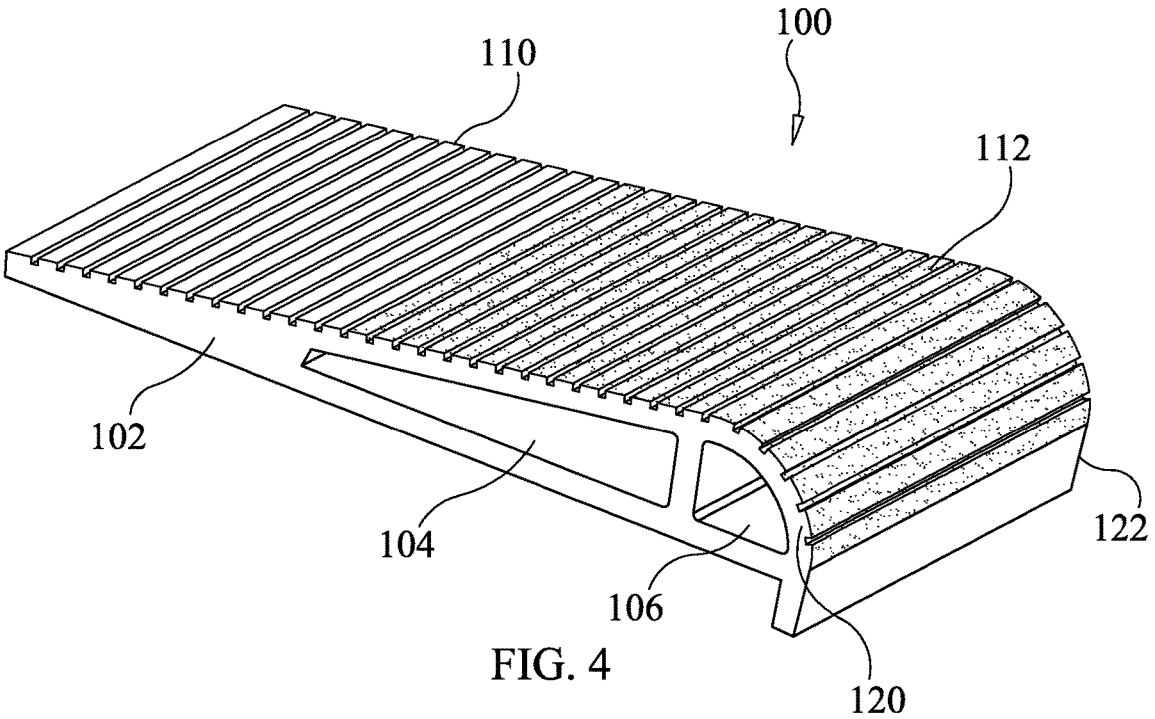
FIG. 4 is a perspective view of the novel front foot starting block of FIG. 1.
Figure 5:
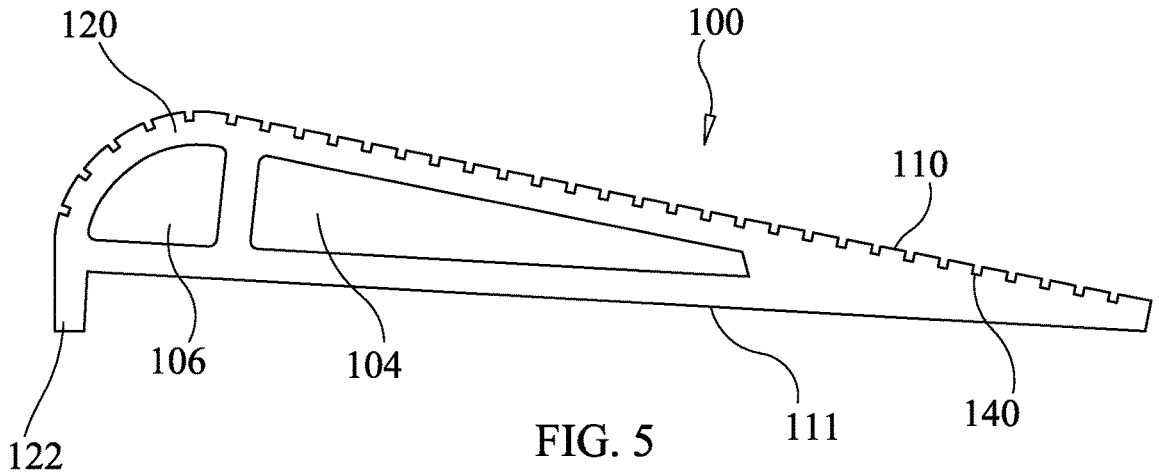
FIG. 5 is a side view of the novel front foot starting block of FIG. 1.

As seen in FIGS. 4 and 5 front starting block 100 in a body member 102 having an upper surface 110, a bottom surface 111 a rounded/curved front portion 120 rounding downward from the front end of upper surface 110, and a lip or flange 122 extending downward from the bottom end of rounded/curved front portion 120. At least a portion of upper surface 110 and/or rounded portion 120 can be provided with an anti-slip/texture surface 112. In addition to or in lieu of surface 112, at least a portion of upper surface 110 and/or rounded portion 120 can be provided with cross grooves 140 preferably extending from one side of starting block body member 102 to the other opposite side of body member 102. Grooves 140 can provide an anti-slip benefit for starting block 100 and can allow water from the swimmer's foot to drain out and not accumulate on upper surface 110 and/or curved portion 120.

As best seen in FIG. 5, in a preferred, but not limiting, embodiment, starting from the back end of starting block 100, bottom surface 111 extends downward at an angle with respect to the position/orientation of upper surface 110.

Though not limiting or required, conventional swim blocks 500 have platforms 504 that are angled downward with the lower point of platform 504 being in the front. The angle relationship between bottom surface 111 and upper surface 110 preferably can correspond to (i.e. is the same or virtually the same) or can be close to the angle of platform 504 such that when front starting block 100 is secured to swim block 500 upper surface 110 can be in a horizontal or at least a substantially horizontal position (See FIG. 6) with respect to the swimming pool.

Body member 102 can be provided with or define at least one aperture and in one non-limiting embodiment, body member 102 can be provided with an aperture/passageway 104 and an aperture/passageway 106. As seen in FIG. 1, securement strap 20 can be fed through aperture/passageway 104 when securing front starting block 100 to swim block 500, though other attachment mechanism can also be used and are considered within the scope of the disclosure.

Figure 6:
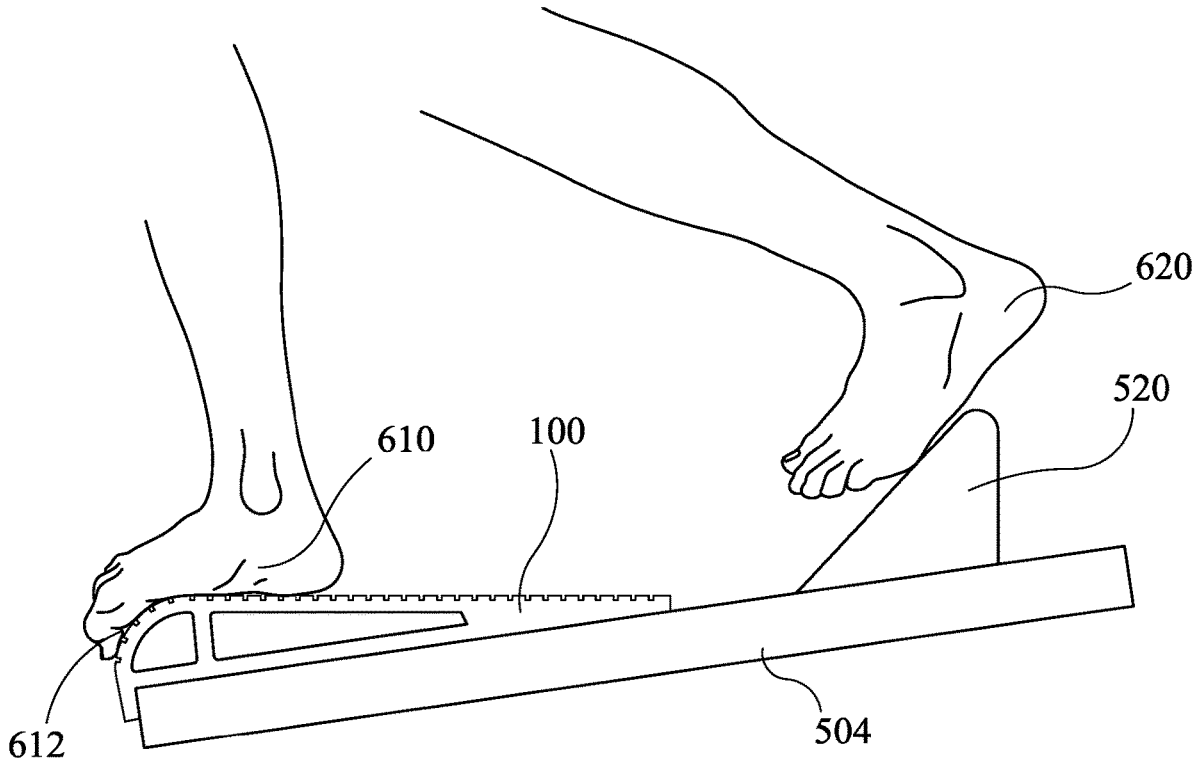
FIG. 6 is a side view of the novel front foot starting block of FIG. 1 or FIG. 2 and showing a preferred contact position of the swimmer's/user's front foot with the novel front foot starting block in accordance with the present disclosure.

To properly position front starting block 100 on platform 504 and to prevent front starting block 100 from being pulled or otherwise moved further inward, lip/flange 122 can be provided which contacts the front surface of platform 504 (i.e. acts as a stop member) when bottom surface 111 is resting upon the upper surface 510 of platform 504 (See FIG. 6). As also seen in FIG. 6, in use, the user's front foot 610 (excluding the toe portion 612 which can extend around curved portion 120) rest in a horizontal or substantially horizontal position, with use of the disclosed novel front foot support/starting block 100 and the user's rear foot 620 is positioned angled given the angled foot contact surface of rear starting block 520.

Figure 7:
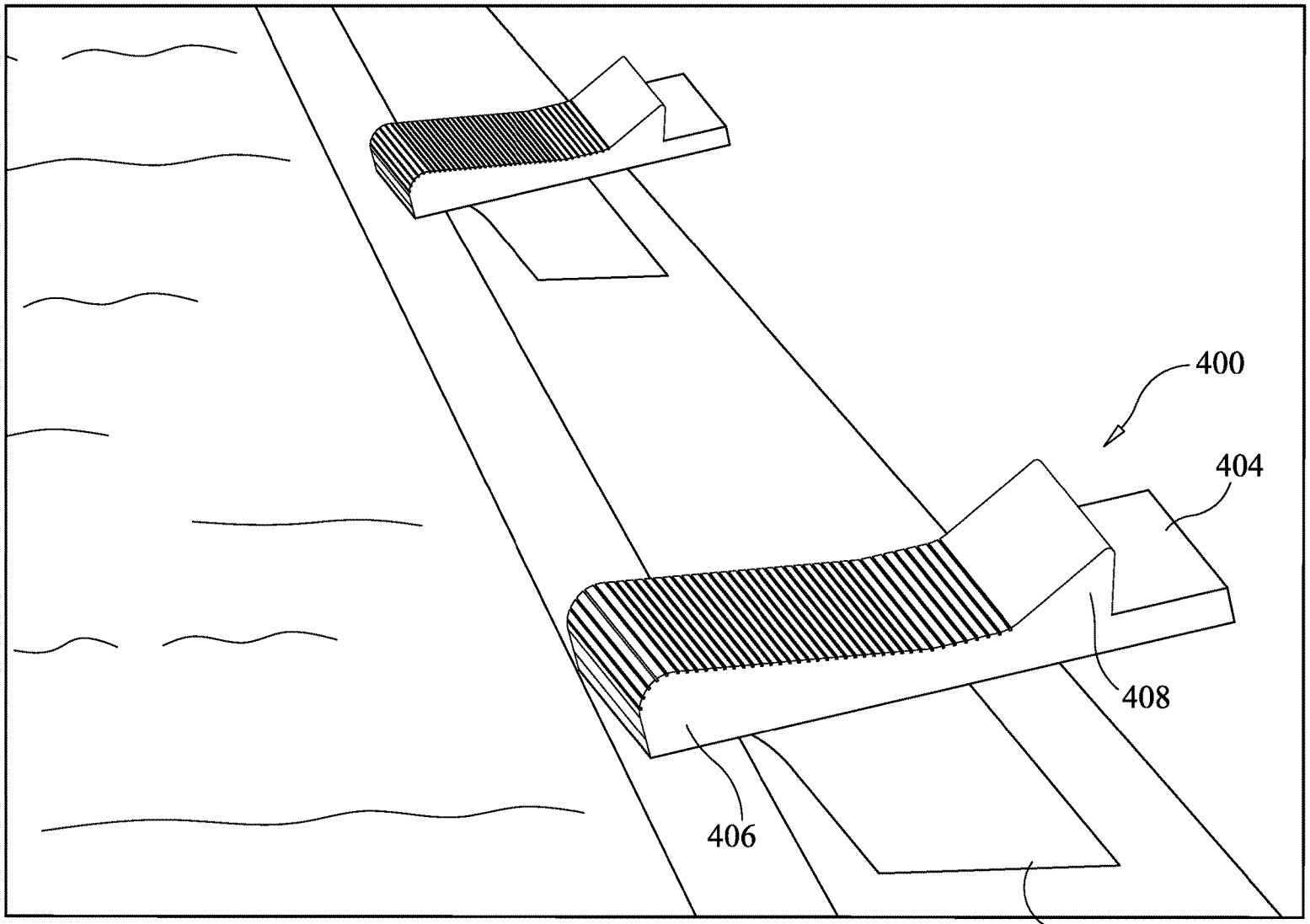
FIG. 7 is a perspective view of another embodiment where the front foot support/starting block in built in and/or incorporated into a newly manufactured swim block/platform in accordance with the present invention.

FIG. 7 illustrates another non-limiting embodiment wherein the features of the front starting block and the rear starting block are incorporated into/built in to new platform 400 having a platform portion 404, front starting block portion 406 with rounded front edge and rear starting block portion 408 (i.e. they are all one piece). Platform 404 rest upon a base/foundation 402, similarly to swim block 500. The front starting block portion 406 can have similar characteristics and features as front starting blocks 100 or 100*a* or the front block portion of combo starting block 200 and rear starting block portion 406 can have similar characteristics and features as the rear block portion of combo starting block 200 and all are incorporated by reference into the description of new platform 400.

Though optional and not required, at least a portion of the foot contact surface of the back foot support portion of combo block 200 or newly manufactured swim block 400 can be provided with an anti-slip/textured surface.

The novel front and combo starting blocks can be constructed from any material and in certain non-limiting embodiments can be constructed from a plastic, metal, steel or stainless steel material.

The novel devices described above can provide for continuous upper-surface supports supporting the front leg, which can significantly assist a swim competitor in kick-off from the conventional swim block during a swim meet/competition/or during practice.

In one non-limiting embodiment for front foot starting block 100, front foot support/starting block can comprise a carrier structure/body member preferably fitting to the starting swim block of the swimming pool, with the body member having a single continuous upper surface support between the front edge and the rear edge, with a front curved portion extending downward from the front edge to provide for a progressive curve profile at the front of the body member for contact with the toes of the user's front foot. Preferably, the front curved portion and the upper surface are monolithically formed or constructed integral as a one-piece member (i.e. the upper surface and the front curve portion are continuous) so that a front edge for the upper surface is not actually visible in the final product. The body member can be designed so that the swimmer can easily fit the device to the surface of the platform of the starting block;

It should also be recognized that one or more suction cups or one part of a hook and loop fastening assembly can be provided on the bottom surface of devices 100, 100*a* or 200*a* as an alternative way of removably securing the devices to the swim block (the other part of the hook and loop assembly would be provided on the upper surface 510 of swim platform 504). Other conventional securement/attachment mechanisms, such as, but not limited to, tapes, can also be used and are considered within the scope of the disclosure. Additionally and also within the scope of the disclosure, for a permanent or more permanent securement of devices 100, 100*a* or 200*a*, an adhesive material/composition (i.e. glue, etc.) can be provided on at least a portion of the bottom surface and/or on a portion of the contact surface of the lip member which makes contact with one or more surface of swim platform 504 to adhere device 100, 100*a* or 200*a* to swim platform 504.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from their spirit and scope.

All components and parts of the novel front foot and combo blocks described herein and their locations, attachment or securement mechanisms, fastening mechanisms, dimensions, values, materials, shapes, etc. discussed above or shown in the drawings, if any, are merely by way of example and are not considered limiting and other component(s) and their locations, attachment or securement mechanisms, fastening mechanisms, dimensions, values, materials, shapes, etc. can be chosen and used and all are considered within the scope of the disclosure.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

The benefits, advantages, solutions to problems, and any element(s) that may cause any benefit, advantage, or solution to occur or become more pronounced are not to be construed as a critical, required, or essential features or elements of any or all the claims.

While the novel front foot and combo starting blocks have been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A front foot starting block adapted for removable attachment and detachment to a swim block disposed at an end of a swimming pool to allow a user to jump or dive off the swim block with more force and distance when entering the swimming pool, the swim block having a swim platform and a base, the swim platform having an upper surface and a front side surface, and the base extending substantially vertically downward from the swim platform and connecting the platform to a perimeter area at the end of the swimming pool, the front foot starting block comprising:

a body member having a front end and a back end, the body member sized and configured to receive at least one foot of the user, the body member comprising:

an upper surface;

a bottom surface;

a curved front portion at the front end, the curved front portion rounding downward from a front end of the upper surface towards a front end of the bottom surface; and a lip member extending downward from a bottom end of the curved front portion and below the front end of the bottom surface, wherein the body member is configured to be removably attached to and detached from the swim block such that when attached to the swim block, the bottom surface of the body member contacts the upper surface of the swim platform and the lip member contacts the front side surface of the swim platform.

2. The front foot starting block of claim 1 wherein the bottom surface and the upper surface meet or are near to each other at the back end of the body member and the bottom surface angles downward towards the front end of the body member at an acute angle with respect to the upper surface of the body member.

3. The front foot starting block of claim 2 wherein an angle selected for the acute angle corresponds to an angle that the swim platform is positioned at with respect to ground.

4. The front foot starting block of claim 2 wherein an angle selected for the acute angle allows the upper surface of the body member to be in a horizontal or substantially horizontal position with respect to ground when the body member is removably attached to the swim block.

5. The front foot starting block of claim 1 further comprising an anti-slip surface disposed on at least a portion of the upper surface of the body member.

6. The front foot starting block of claim 5 further comprising an anti-slip surface disposed on at least a portion of the curved front portion of the body member.

7. The front foot starting block of claim 1 further comprising a plurality of grooves or passageways in the upper surface of the body member and extending from a first side to an opposite second side of the upper surface of the body member.

8. The front foot starting block of claim 7 further comprising one or more grooves or passageways in the curved front portion of the body member extending from a first side to an opposite second side of the curved front portion of the body member.

9. The front foot starting block of claim 1 wherein the upper surface of the body member is in a horizontal or substantially horizontal position with respect to ground when the body member is removably attached to the swim block.

10. The front foot starting block of claim 1 wherein the body member sized to receive both feet of the user.

11. The front foot starting block of claim 1 wherein the body member further comprising a rear foot support having a contact surface beginning at the back end of the body member, the contact surface extending upward at an angle from the back end of the body member.

12. The front foot starting block of claim 1 wherein the body member having a passageway extending from a first side to an opposite second side and configured to receive a strap through the passageway to removably secure the body member to the swim block; wherein the passageway and the strap are externally accessible to the user when the body member is removably secured to the swim block.

13. A front foot starting block adapted for removable attachment and detachment to a swim block disposed at an end of a swimming pool to allow a user to jump or dive off the swim block with more force and distance when entering the swimming pool, the swim block having a swim platform and a base, the swim platform having an upper surface and a front side surface, and the base extending substantially vertically downward from the swim platform and connecting the platform to a perimeter area at the end of the swimming pool, the front foot starting block comprising:

a one-piece body member having a front end and a back end, the body member having a width extending from a first side of the body member to an opposite second side of the body member, wherein the width of the body member sized to receive at least one foot of the user, the body member comprising:

an upper surface;

a bottom surface;

a curved front portion at the front end, the curved front portion rounding downward from a front end of the upper surface towards a front end of the bottom surface; and a lip member extending downward from a bottom end of the curved front portion and below the front end of the bottom surface, wherein the bottom surface and the upper surface meet or are near to each other at the back end of the body member and the bottom surface angles downward towards the front end of the body member at an acute angle with respect to the upper surface of the body member, and wherein the body member is configured to be removably attached to and detached from the swim block such that when attached to the swim block, the bottom surface of the body member contacts the upper surface of the swim platform and the lip member contacts the front side surface of the swim platform and the upper surface of the body member is in a horizontal or substantially horizontal position with respect to ground.

14. The front foot starting block of claim 13 further comprising an anti-slip surface disposed on at least a portion of the upper surface of the body member and on at least a portion of the curved front portion of the body member.

15. The front foot starting block of claim 13 further comprising a plurality of grooves or passageways in the upper surface of the body member and extending from a first side to an opposite second side of the upper surface of the body member and one or more grooves or passageways in the curved front portion of the body member extending from a first side to an opposite second side of the curved front portion of the body member.

16. The front foot starting block of claim 13 wherein the width of the body member is sized to receive both feet of the user.

17. The front foot starting block of claim 13 wherein the body member further comprising a rear foot support having a contact surface beginning at the back end of the body member, the contact surface extending upward at an angle from the back end of the body member.

18. The front foot starting block of claim 13 wherein the body member having a passageway extending from a first side to an opposite second side and configured to receive a strap through the passageway to removably secure the body member to the swim block; wherein the passageway and the strap are externally accessible to the user when the body member is removably secured to the swim block.

19. A front foot starting block adapted for removable attachment and detachment to a swim block disposed at an end of a swimming pool to allow a user to jump or dive off the swim block with more force and distance when entering the swimming pool, the swim block having a swim platform and a base, the swim platform having an upper surface and a front side surface, and the base extending substantially vertically downward from the swim platform and connecting the platform to a perimeter area at the end of the swimming pool, the front foot starting block comprising:

a body member having a front end and a back end, the body member sized and configured to receive at least one foot of the user, the body member comprising:

an upper surface;

a bottom surface;

a curved front portion at the front end, the curved front portion rounding downward from a front end of the upper surface towards a front end of the bottom surface; and a lip member extending downward from a bottom end of the curved front portion and below the front end of the bottom surface, wherein the body member is configured to be removably attached to and detached from the swim block such that when attached to the swim block, the bottom surface of the body member contacts the upper surface of the swim platform and the lip member contacts the front side surface of the swim platform; and wherein the body member having a passageway extending from a first side to an opposite second side and configured to receive a strap through the passageway to removably secure the body member to the upper surface of the swim platform of the swim block; wherein the passageway and the strap are externally accessible to the user when the body member is removably secured to the upper surface of the swim platform of the swim block.

* * * * *